US007603830B2

(12) United States Patent
Nowakowski

(10) Patent No.: US 7,603,830 B2
(45) Date of Patent: Oct. 20, 2009

(54) APPARATUS FOR AUTOMATIC BELT PRESSURE ADJUSTMENT FOR COUPON SEPARATION

(75) Inventor: Anthony J. Nowakowski, Crystal Lake, IL (US)

(73) Assignee: Carol Joyce Witt, Lake Zurich, IL (US)

( * ) Notice: Subject to any disclaimer, the term of this patent is extended or adjusted under 35 U.S.C. 154(b) by 0 days.

(21) Appl. No.: 12/020,901

(22) Filed: Jan. 28, 2008

(65) Prior Publication Data

US 2009/0188212 A1 Jul. 30, 2009

(51) Int. Cl.
*B65B 63/00* (2006.01)
*B26F 3/00* (2006.01)

(52) U.S. Cl. ..... 53/435; 53/513; 53/167; 225/100

(58) Field of Classification Search ..... 53/435, 53/445, 58, 57, 513, 167; 225/97, 100, 10, 225/106

See application file for complete search history.

(56) References Cited

U.S. PATENT DOCUMENTS

| | | | | | |
|---|---|---|---|---|---|
| 2,800,180 | A | * | 7/1957 | Jensen | 225/4 |
| 3,672,551 | A | * | 6/1972 | Peterson | 225/100 |
| 3,675,542 | A | * | 7/1972 | Torigoe | 493/194 |
| 3,730,411 | A | * | 5/1973 | Brockmuller | 225/100 |
| 3,741,451 | A | * | 6/1973 | Parenti et al. | 225/100 |
| 4,025,023 | A | * | 5/1977 | Moffitt | 225/100 |
| 4,068,835 | A | | 1/1978 | Bortner | |
| 4,217,744 | A | * | 8/1980 | Mizutani | 53/55 |
| 4,284,221 | A | * | 8/1981 | Nagel et al. | 225/100 |
| 4,498,894 | A | * | 2/1985 | Kuckhermann | 493/234 |
| 4,606,534 | A | * | 8/1986 | Gombault | 270/52.11 |
| 4,623,081 | A | * | 11/1986 | Hain et al. | 225/105 |
| 4,688,708 | A | * | 8/1987 | Irvine et al. | 225/100 |
| 4,867,628 | A | | 9/1989 | Ammon et al. | |
| 5,297,711 | A | * | 3/1994 | Kogan | 225/98 |
| 5,427,294 | A | * | 6/1995 | VandenHeuvel et al. | 225/4 |
| 5,464,142 | A | * | 11/1995 | Mol et al. | 225/100 |
| 5,549,233 | A | | 8/1996 | Clauser | |
| 5,588,280 | A | * | 12/1996 | Kotsiopoulos | 53/435 |
| 5,784,861 | A | | 7/1998 | Kotsiopoulos | |
| 5,785,224 | A | | 7/1998 | Nowakowski | |
| 5,941,053 | A | | 8/1999 | Kotsiopoulos | |
| 5,966,906 | A | | 10/1999 | Kuehl et al. | |
| 6,082,079 | A | * | 7/2000 | Kuehl et al. | 53/520 |
| 6,206,262 | B1 | * | 3/2001 | Achelpohl et al. | 225/100 |
| 6,673,002 | B2 | * | 1/2004 | Trovinger et al. | 493/405 |
| 6,722,108 | B1 | | 4/2004 | Kotsiopoulous | |
| 7,201,343 | B2 | * | 4/2007 | Mabit | 242/419.5 |
| 2004/0149767 | A1 | | 8/2004 | Boehm et al. | |

* cited by examiner

*Primary Examiner*—Paul R Durand
(74) *Attorney, Agent, or Firm*—Greer, Burns & Crain, Ltd.

(57) ABSTRACT

A coupon insertion apparatus configured for sequentially inserting coupons into receiving containers, including a machine frame, at least one pair of opposed rollers mounted to the frame and adjustable between a closed position and an open position. A moving carriage system including a main carriage housing having one roller of each of the at least one pair of rollers that are automatically slidably adjustable between open and closed positions. A control system is constructed and arranged for automating the movement of the main carriage relative to the machine frame.

18 Claims, 6 Drawing Sheets

APPARATUS FOR AUTOMATIC BELT PRESSURE ADJUSTMENT FOR COUPON SEPARATION

BACKGROUND OF THE INVENTION

Some coupon insertion devices separate the forwardmost coupon from a continuous web (coupon source) and eject the separated coupon into a container as the container passes a designated location for insertion. The present invention relates to an apparatus for automatically adjusting the pressure (or space) between a pair of opposed rollers to effectuate coupon separation.

It is a common advertising and promotional technique to place coupons or other items into containers, such as cartons for breakfast cereal or snack items, along with the product to be sold. The consumer may use the coupon for whatever purpose intended, such as for discounts on future purchases or a rebate. Many devices have been provided for depositing coupons into containers in the present day packaging industry.

It is to be understood that the word "coupon" is used in its broadest possible sense to include any coupon, card, sheet, receipt, warranty, ticket prize, premium or other part, whether two-dimensional or three-dimensional, that can advantageously be handled as described hereinafter. Similarly, "container" is used in the broadest possible sense to include containers such as boxes, tubs, cans and vessels of all kinds as well as any other coupon-receiver which can advantageously be used with the present system.

Commonly assigned U.S. Pat. Nos. 5,784,861, 5,588,286, and 5,941,053, each fully incorporated by reference herein, disclose coupon insertion devices receiving a supply of coupons from a reel and inserting them sequentially into an array of containers. The coupons are fed between first and second pairs of opposing rollers. The rollers may be a single roller, a pair of rollers or more than two rollers. When more than one roller is utilized, it is contemplated that a belt is secured by the two rollers to effectuate movement in the direction of the rollers. Differential speeds of the first and second pairs of rollers create what is known by those skilled in the art as "bursting" through which the forwardmost coupon is separated and projected into the container. Bursting is where the faster of the pairs of rollers is able to effectuate separation of an entering coupon from the coupon source.

While prior devices are effective in inserting flat or two-dimensional coupons into containers, there has been a need for similar equipment used for three-dimensional coupons having a height or thickness which is greater than conventional flat coupons, and/or which are irregular in configuration. In instances where the coupon is three-dimensional, damage to the coupon as a result of too much pressure being applied is a possibility.

Coupon insertion devices have been introduced in which the opposing pairs of rollers are vertically adjustable relative to each other to accommodate coupons of varying sizes and shapes. Such systems typically employ drive belts to power the rollers in the opposing sets and a crank shaft to adjust the space between the rollers. However, a corresponding design issue is maintaining desired pressure applied between opposing sets of rollers as the apparatus is adjusted to accommodate coupons of varying thicknesses.

Conventional coupon insertion devices have addressed similar problems through the use of manual cranks for adjusting pressure applied to the coupons. However, these systems increase the complexity of the apparatus and the associated manufacturing and repair cost. In addition, these systems have been found to increase wear of the drive belts. Also, these systems did not address the situation where there was "slipping" of a coupon, i.e., where the entering coupon was directed to be torn off the coupon source but did not separate.

BRIEF SUMMARY OF THE INVENTION

The above-listed needs are met or exceeded by the present apparatus for automatic belt pressure adjustment for coupon separation which features a control system for automatically moving the upper rollers relative to the lower rollers to adjust the spacing for accommodating coupons of varying shapes or thicknesses. A moving carriage system includes a main carriage housing that supports the upper rollers. The main carriage housing is adapted to be slidably adjustable between the closed and open positions, such that in the closed position, the space between the upper rollers and lower rollers is relatively small. In addition, the present system includes a coupon sensor disposed between the opposed pairs of rollers to determine whether a coupon has passed from one pair of rollers to the second. In the event that the coupon does not pass, an automated belt adjustment is initiated to apply more pressure (decrease the space between the upper and lower rollers) to the surface of the entering coupon so that more pressure is applied to allow the coupon to effectuate separation from the first set of rollers to the second set of rollers.

More specifically, a coupon insertion apparatus for inserting coupons from a coupon source into receiving containers is provided, including a machine frame, at least one pair of opposed rollers including at least one upper roller and at least one lower roller mounted to the machine frame and being adjustable between a closed position and an open position. A moving carriage system includes a main carriage housing having the at least one upper roller automatically slidably adjustable between the closed and open positions, when in the closed position, the main carriage pressures a surface of an entering coupon for effectuating separation of the entering coupon from the coupon source. A control system is constructed and arranged for automating movement of the main carriage relative to the machine frame.

In another embodiment, a coupon insertion system is configured for sequentially inserting coupons into receiving containers. The coupon insertion system includes a portable frame, at least one pair of opposed rollers mounted to the frame and adjustable between a closed position and an open position. A moving carriage system includes a main carriage automatically slidably adjustable between the open and closed positions. When in the closed position the main carriage pressures a surface of an entering coupon for effectuating separation of the entering coupon from the coupon source. A control system is also provided for automating movement of the main carriage.

In still another embodiment, a method for inserting coupons from a coupon source to a receiving container is provided. The method includes the steps of feeding an entering coupon from the coupon source into at least one pair of opposed rollers which are adjustable between a closed and an open position. The at least one pair of opposed rollers includes an upper roller mounted to a main carriage housing and a lower roller mounted to a frame. Next, the position of a main carriage system including the main carriage housing is automatically slidably adjusted using a motor to apply pressure to the entering coupon to effectuate separation of the entering coupon from the coupon source by positioning the at least one pair of rollers in the closed position. Lastly, the opposed rollers are driven in both the closed and open positions such that the entering coupon is separated from the coupon source and directed across a second pair of opposed rollers and into a receiving container.

DETAILED DESCRIPTION OF THE INVENTION

Generally, the present coupon insertion apparatus receives a continuous web of separatable coupons (also known as a coupon source), pulls the entering coupon away from the coupon source, such as a reel of coupons, and dispenses the separated coupon at a predetermined time into a moving container as it passes a predetermined location. The present coupon insertion apparatus automatically adjusts the position between a pair of opposed rollers on the surface of the entering coupon. The rollers may be a single roller, a pair of rollers or more than two rollers. When more than one roller is utilized, it is contemplated that a belt is secured by the more than one roller. For purposes of the present application, the rollers are described individually or as a pair. It is to be understood, however, that in many embodiments of the present invention, a belt is secured by the rollers to effectuate movement in the direction of the rollers. The closer together the rollers are is known as the closed position, while when the rollers are further apart, is known as the open position. A main carriage housing is automatically slidably adjustable to adjust the space between the rollers to account for varying dimensions of the coupon, such that a three-dimensional coupon can be separated from a coupon source as easily has a two-dimensional coupon. An exemplary conventional coupon insertion apparatus is described in greater detail in commonly assigned U.S. Pat. No. 5,784,861, hereby fully incorporated by reference.

Figure 1:
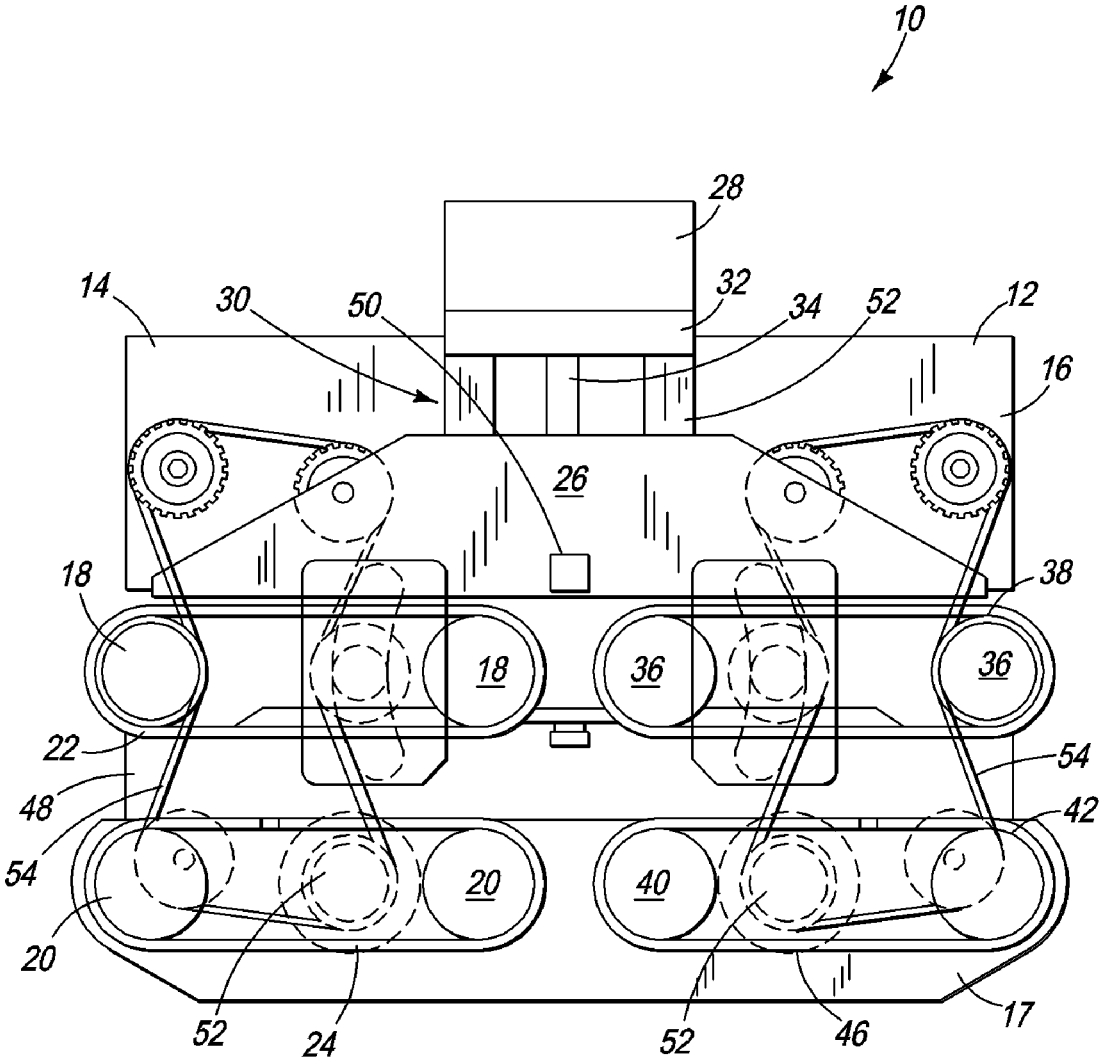
FIG. 1 is a front view of the present coupon insertion apparatus provided with the present belt tensioning apparatus shown in a partially open position.
Figure 2:
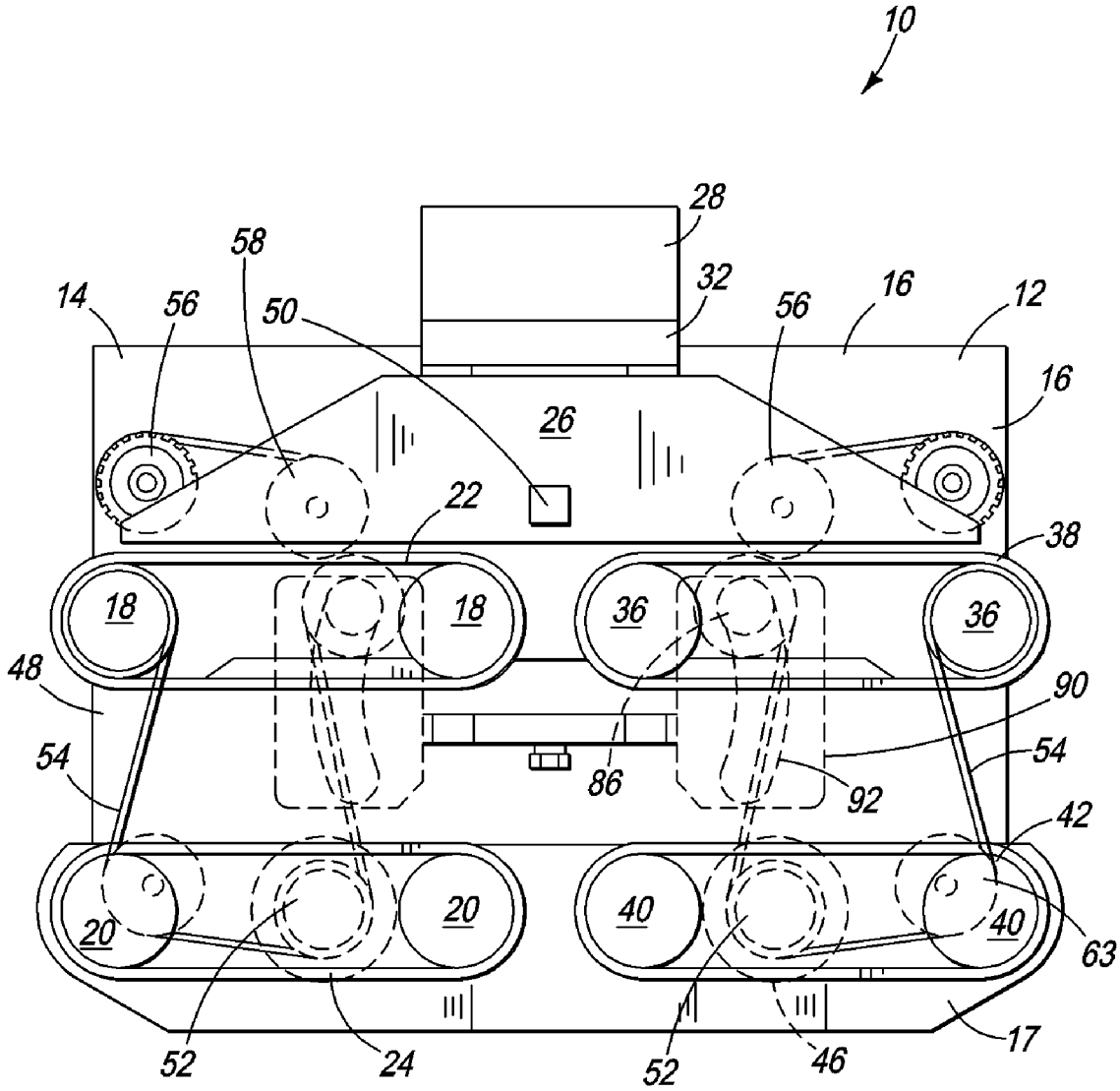
FIG. 2 is a front view of the present coupon insertion apparatus provided with the present belt tensioning apparatus shown in a fully open position.
Figure 3:
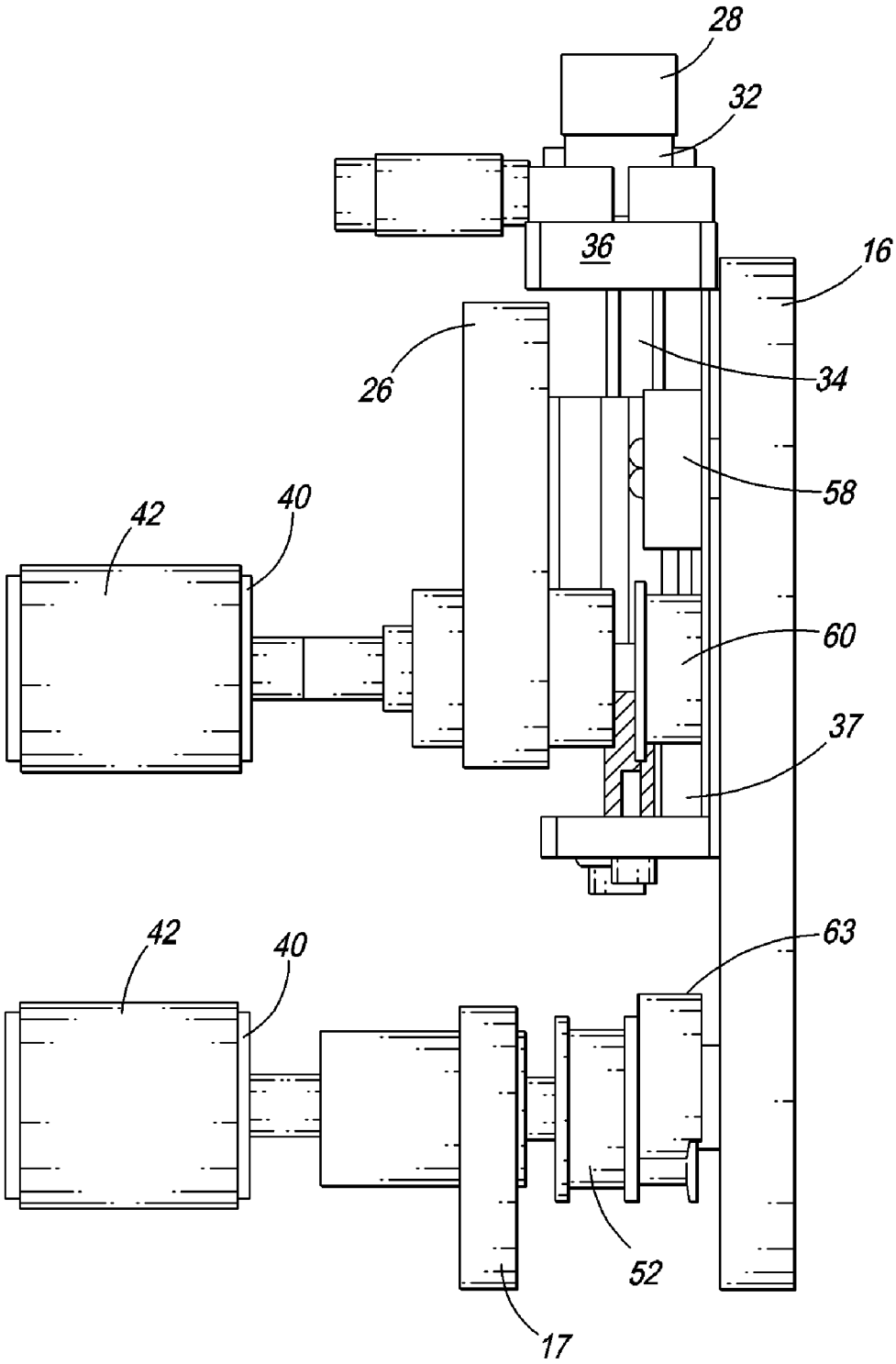
FIG. 3 is a side view of the present coupon insertion apparatus in a partially open position.

Referring now to FIGS. 1-3, a coupon insertion apparatus is generally designated 10 and is shown in a front view. Prior to operation, the apparatus 10 is positioned relative to a container conveyor line (not shown) to accurately sequentially dispense or project coupons into passing containers. As is customary in the art, the apparatus 10 is commonly referred to as having a left side 12 and a right side 14, which are opposite to the views as seen in FIG. 1. While the apparatus 10 can be fed a supply of coupons (from either direction), for purposes of the present invention it will be assumed that the coupons are being fed from the left side 12 and are projected from the right side 14 into the container (not shown).

The apparatus 10 includes a machine frame 16. Machine frames 16 for use in the present invention can be of any rigid material, preferably sufficiently rigid so as to withstand the torque being applied by the motor 28 on the main carriage housing 26, also referred to herein as the main carriage. It is contemplated that the machine frame 16 be a continuous sheet of metal large enough to accommodate at least one pair of opposed rollers, the moving carriage housing 26 and drive belts as described above. It is also contemplated that the machine frame 16 may be hollow, such that the frame only includes areas where the rollers or main carriage 26 are attached to it. This is desired, for example, in portable applications where it is desired that the apparatus be as light as possible. Importantly, it is contemplated that certain embodiments of the present coupon separation apparatus are easily maneuverable, such that the apparatus may be mounted on wheels or able to be easily disassembled and reassembled. The present frame remains stationary during coupon insertion, and to which are mounted a drive frame 17 and a plurality of opposed upper and lower positioning rollers 18 and 20, each plurality of rollers being surrounded by a respective suitable endless conveyor belt 22, 24. The belts 22, 24 are preferably made of a resilient, rubber or rubber-like material with enhanced coupon gripping properties to facilitate the movement of coupons through the apparatus 10.

While the lower positioning rollers 20 are positioned on the drive frame 17 at a fixed location, the upper positioning rollers 18 are vertically movable between a closed position (FIG. 4), and a totally open position (FIG. 2), with a semi or partial open position also available (FIGS. 1 and 3). The upper positioning rollers 18 are preferably mounted on a main carriage housing 26. It will be understood that the distance or displacement between the upper and lower rollers 18, 20 is a function of the configuration of the coupon. In the preferred embodiment, there is an approximate 2 inch gap between the closed and open positions; however it will be understood that this dimension may vary to suit the application. Generally flat or planar coupons will require the apparatus to be adjusted to the closed position, while three-dimensional inserts such as small plastic toys or other prizes may require the fully open position, depending on their size.

The vertical adjustment of the upper rollers 18 is accomplished using a motor 28 to automatically slidably adjust the position of the main carriage housing 26, which is mounted on a linear slide 30 and includes a main support block 32 secured to the machine frame 16. A captured, rotatable threaded rod 34 (FIGS. 1 and 3) is axially rotatable in a support bracket 37 through suitable bearings (not shown) and is rotated automatically by the motor 28. A threaded bore (not shown) in the main carriage housing 26 receives the threaded rod 34. The motor 28 rotates the threaded rod 34 as would be understood by those of ordinary skill in the art, thereby vertically moving the main carriage housing 26, the direction of movement of the carriage housing being a function of the direction of rotation of the motor 28. It is also contemplated that a manual rotation technology may be included, preferably as a back up system. The upper rollers 18 are secured to main carriage housing 26. Thus, as the main carriage 26 moves, so do the upper rollers 18. While three basic positions have been described, depending on the amount of rotation along the threaded rod 34, there are many possible distances between the upper and lower positioning rollers 18, 20 to provide for accommodation of a variety of coupon sizes.

In the preferred coupon insertion apparatus 10, there are two sets of upper rollers, the upper positioning rollers 18, and a plurality of upper feed rollers 36, also provided with a corresponding endless conveyor belt 38. The upper feed rollers 36 oppose a corresponding set of lower feed rollers 40, also provided with a corresponding conveyor belt 42. The belts 22, 24, 38 and 42 are preferably of similar construction. It will be understood that the feed rollers 36, 40 are duplicates of the positioning rollers 18, 20, and as such the following description of the positioning rollers will apply to the feed rollers as well.

The feed rollers 36, 40 receive the coupons from the feed roll or bandolier (coupon source), depending on the particular coupon, and passing the coupons to the positioning rollers 18, 20, which ultimately transmit or project the coupons into the waiting container. However, as discussed above, the apparatus 10 is usable in either direction, so that the feed rollers 36, 40 can become the positioning rollers 18, 20.

During bursting or separation of the entering coupon from the coupon source, the positioning rollers 18, 20 are driven at a predetermined rotational speed by a drive source 52 such as a servo drive motor. Other motors may also be used, as would be appreciated by those skilled in the art. At the same time, the feed rollers 36, 40 are stopped. The feed rollers 36, 40 draw a web of coupons toward a bight 48 formed by the positioning rollers 18, 20.

At a predetermined time, the positioning rollers 18, 20 tear the forwardmost coupon from the next succeeding coupon along the perforated line of separation and inject forwardmost coupon at a predetermined location. The feed rollers 36, 40 then cause the leading edge of the forwardmost coupon to enter the bight 48 between positioning rollers 18, 20. At least one coupon sensor 50 is provided in operational relationship to the rollers 18, 20 and 36, 40 to provide a control system with sensed coupon location information. The location of the sensor 50 may vary to suit the application. For example, a sensor may be provided between the lower, fixed rollers. As is known in the art, and described in greater detail in U.S. Pat. No. 5,784,861, variations in the speeds of the motors 44, 46 cause coupons to be sequentially separated from the web of coupons and projected at high speed into a designated container.

Figure 4:
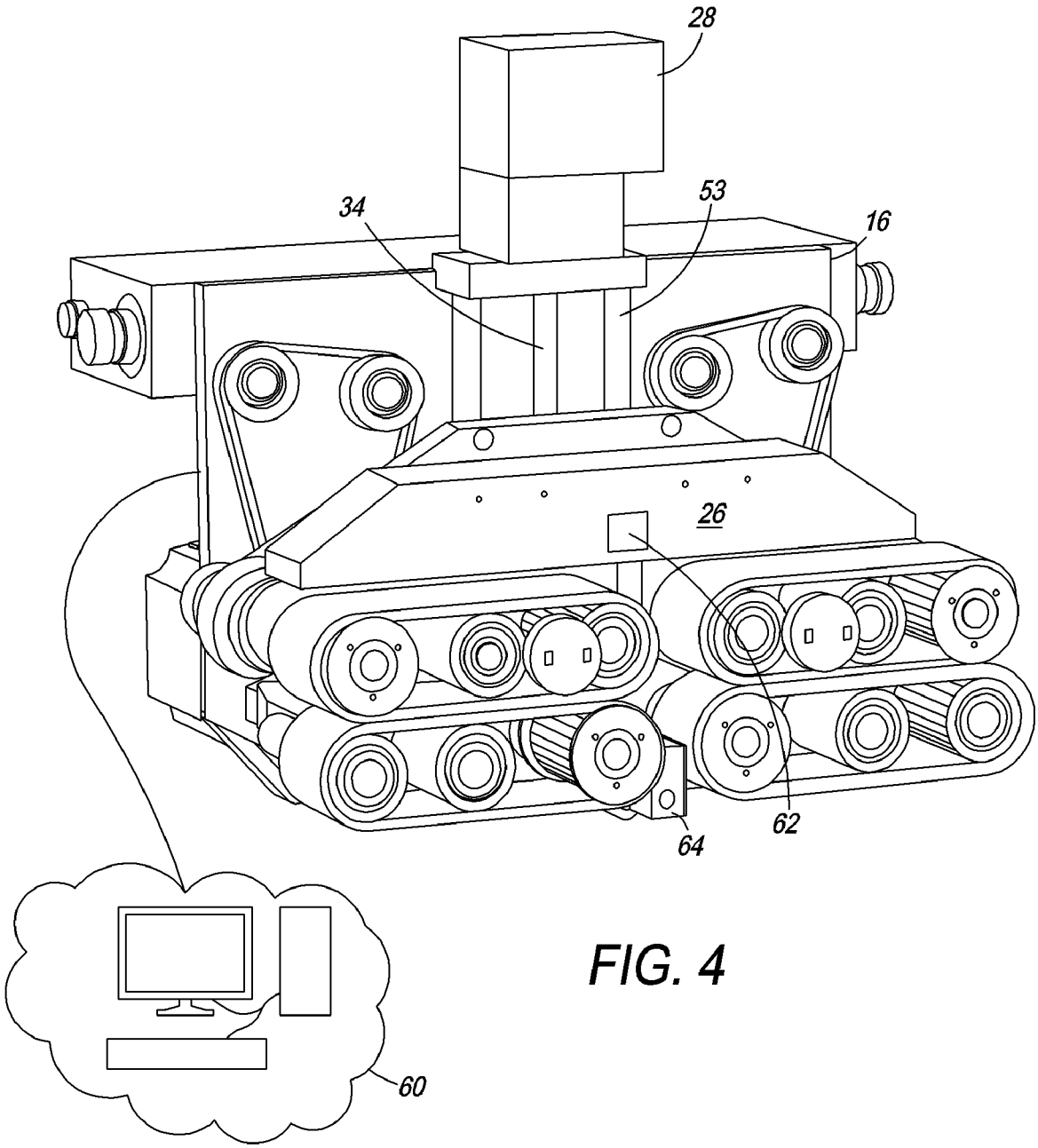
FIG. 4 is a fragmentary top perspective view of the present coupon insertion apparatus in a fully closed position.

Referring now to FIG. 4, the machine frame 16 also preferably includes a pair of parallel rails 53 located on either side of the threaded rod 34 for enhancing stability of the main carriage housing 26 in its reciprocal vertical movement controlled by the motor 28. Each rail 53 is preferably located an even distance from the threaded rod 34 to support movement of the main carriage housing 26 and ensure that the main carriage housing moves evenly. It is contemplated that apertures (not shown) exist in the main carriage 26 for each of the parallel rails 53. Alternatively and additionally, it is contemplated that the rails 53 may fit into a groove (not shown) located in either the front or the back surface of the main carriage housing 26. Preferably, each rail 53 is non-threaded, although in certain embodiments, for example when the weight of the main carriage housing 26 is large, it may be desired to included threaded rails similar to the threaded rod 28 to support the weight of the main carriage housing. It is contemplated that an aperture is located at the center of the main carriage housing 34 such that when in a vertical position, the weight of the main carriage housing 34 is distributed evenly across the threaded rod 28.

The present coupon separation apparatus 10 also preferably includes a control system 60 that is constructed and arranged for automating movement of the main carriage housing 26 relative to the machine frame 16 along the axis of the threaded rod 34. Once a coupon enters the bight 48 between the rollers 18, 20 the control system 60 signals the motor 28 to move the opposed rollers to the closed position, to obtain the coupon separation as described above. The control system 60 automates the amount of torque applied via the threaded rod 34 for moving the main carriage housing 26 to the closed position (as well as the open position).

The moving carriage system preferably also includes an orientation sensor 62 that is constructed and arranged for determining the orientation of the coupon separation apparatus 10 and communicating the orientation to the control system 60. It is contemplated that the coupon separation apparatus 10 may be positioned in any manner convenient to separate the coupon from the coupon source and distribute the coupon into a container or the like. Moreover, it is contemplated that orientation sensor 62 may be positioned anywhere on the machine, including on the moving carriage, on the frame or internally, for example, in an electric box.

It is also contemplated that an existing assembly line may not have sufficient room to allow addition of a separate coupon separation apparatus. Therefore, it is contemplated that the present coupon separation apparatus may be angled, or raised, or even inverted to accommodate being added to an existing assembly line. Since gravity assists the movement of the main carriage housing 26 toward the open position, if the apparatus 10 is inverted, the motor 28 will have to work harder to move the main carriage housing to the same position, since the unit will be operating against gravity. Thus, the control system 60 is configured to accommodate such changes in motor loading.

Figure 5:
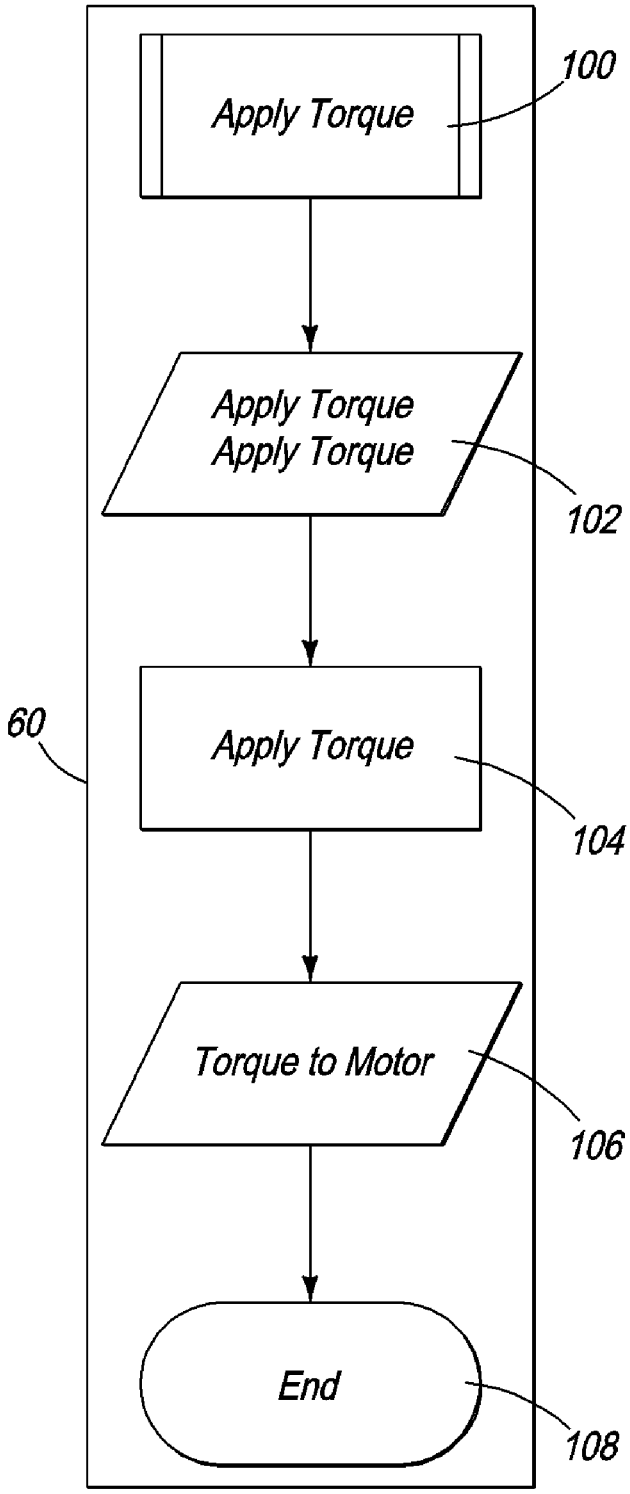
FIG. 5 is a flow diagram for determining the amount of torque to be utilized to move the main carriage to the closed position as in FIG. 6.

Referring now to FIG. 5, once the angle of orientation of the coupon separation apparatus 10 is communicated to the control system 60 by the orientation sensor 62, the control system accordingly adjusts the amount of torque utilized in moving the main carriage housing 26 to the closed position. Once the decision has been made by the control system 60 for the motor 28 to apply a torque at 100 to the threaded rod 34, the orientation angle is read at 102 by the sensor 62, which communicates the information to the control system. The control system 60 will then calculate at 104 the amount of torque to apply to the threaded rod 34, taking into account the angle of the coupon separation apparatus 10 relative to gravity. The control system 60 then applies the calculated amount of torque at 106 to move the main carriage housing 26 to the closed position at 108. For example, when the coupon separation apparatus 10 is in the horizontal position, less torque will be required to move the main carriage 26 to the closed position, since gravity will assist in moving the main carriage housing down based on the weight of the main carriage. In contrast, more torque may be needed if the coupon separation apparatus is mounted in the vertical position. It is contemplated that any amount of torque may be applied depending on the angle that the coupon separation apparatus is positioned.

In operation, the entering coupon from the coupon source is initiated into the coupon separation apparatus 10. Upon initiation of the first coupon, a sensor (not shown), either preferably within the belt of either the upper or lower roller or upon entry of the first ticket onto the lower roller, signals the control system 60 to initiate the process of coupon separation. Upon initiation, the control system 60 signals the motor 28 to raise the main carriage housing to the fully open position, as depicted in FIG. 2. In other embodiments, it is contemplated that the placement of the coupon source is manual, followed by manual lowering of the moving carriage at the beginning. Once initialized, however, it is contemplated that the pressure set forth by the rollers is automatically exerted and adjusted.

Figure 6:
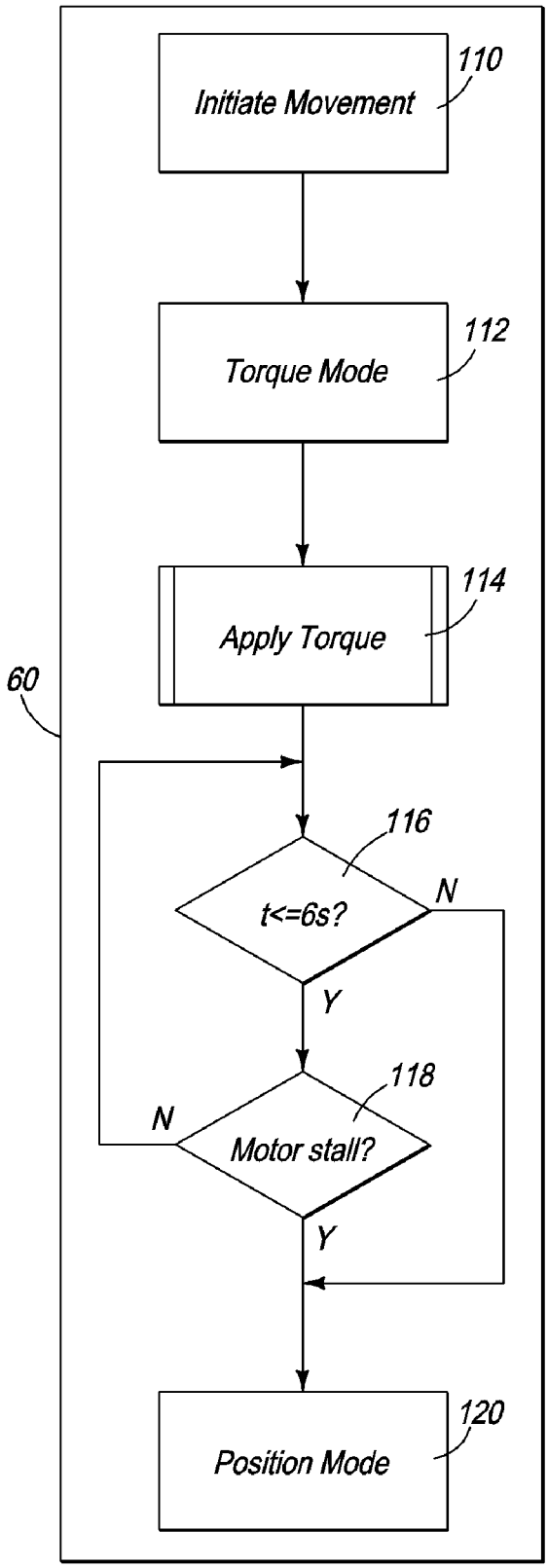
FIG. 6 is a flow diagram of control circuitry for moving the main carriage to the closed position.

Referring now to FIG. 6, once the main carriage 26 is raised and the apparatus 10 is in the fully open position, movement of the coupon is initiated and the apparatus enters the torque mode at 112. The torque mode 112 can be that as described in FIG. 5. Once the torque is determined to be in torque mode, the control system 60 sends a signal to the motor 28 to initiate movement of the main carriage 26 by rotating the threaded rod 34, which causes the main carriage to move to the closed position. Referring again to FIG. 6, once the initiation of torque at 114 is applied to the threaded rod 34, the main carriage 26 will automatically move to the closed position.

Next, the main carriage 26 will move to the closed position for a predetermined time period at 116, preferably six seconds. This time period is based on the particular embodiment shown in FIG. 3 has been optimized based on the time to lower the main carriage 26 in the horizontal position to reach the fully closed position with a two-dimensional coupon. It is contemplated that other time periods could be used depending on, for example, the size of the coupon. For example, if a large three-dimensional coupon were used, it would be desirable to have a fully-opened position with a larger space between the upper and lower rollers 18, 20 and therefore it would take a longer time to adjustably slide the main carriage housing 26 to the closed position.

When the main carriage housing 26 has been lowered for six seconds, the motor 28 automatically stalls, thereby stopping any further movement by the main carriage housing. This is designed to prevent any damage to the coupon and any possible over-exertion of pressure from the top roller 18 on the main carriage housing 26 onto the lower roller 20. Again, it is contemplated that a time period other than six seconds may be utilized depending on the application. Such instances would occur when the coupon, for example, is a three-dimensional object. In such cases, it would take less time for the main carriage housing 26 to be in contact with a top surface of the entering coupon and to exert the desired pressure to the top surface of the coupon. As such, movement of the main carriage housing 26 to the closed position is halted upon exerting pressure on the coupon. It is contemplated that a sensor could be in place to detect this pressure.

Once movement of the main carriage housing 26 to the closed position has been halted, either by the passing of six seconds or by the motor 28 stalling out due to height of the coupon, the position mode is entered at 120. The position mode 120 will hold the carriage housing in its current position. The position mode process is described above with respect to FIGS. 1-3.

As shown in FIG. 4, it is also contemplated that the coupon separation apparatus includes a coupon sensor 64 that operates in conjunction with other sensors, such as a torque sensor or monitor (not shown). The coupon sensor data in conjunction with a component of the torque sensor or monitor data to determine whether a coupon has passed from one set of rollers to the next. It is contemplated that the torque sensor or monitor can be integrated with the control system or may be a separate sensor that preferably communicates with the control system. The coupon sensor 64 is preferably located between the first set of opposed rollers 18, 20 and the second set of opposed rollers 36, 40. The coupon sensor 64 senses when the forwardmost coupon is not successfully burst from the web (passes the second set of rollers 36, 40) while the torque sensor or monitor measures the torque being exerted. The information between the sensors is communicated with the control system 60 to register each coupon that is successfully passed from the first set of rollers to the second set of rollers. This registration information can be tabulated and sent to the control system 60 to monitor coupon serial numbers, the number of coupons sent and/or other such information as would be appreciated by those skilled in the art.

The coupon sensor 64 and torque sensor or monitor can preferably sense when the forwardmost coupon is not successfully burst from the web (passes the second set of rollers 36, 40). If the coupon is burst, the coupon sensor 64 will note the passage of the coupon and the torque sensor or monitor will confirm the amount of torque being applied. This information can then be communicated to the control system 60, which will allow the coupon source to continue feeding coupons to the first set of opposed rollers. In the event that the coupon sensor 64 and torque sensor or monitor detect that a coupon is not passed from the first set of opposed rollers 18, 20 to the second set of opposed rollers 36, 40, the coupon sensor 64 and torque sensor or monitor communicate such information to the control system 60.

In response, the control system 60 exerts more pressure utilizing the motor 28 to adjustably slide the main carriage housing 26 even further to the closed position, on the surface of the next coupon to promote separation of the coupon between the first and second pair of opposed rollers 18, 20. The coupon sensor 64 will then detect again following the exertion of more pressure on the surface of the coupons.

Provided that the coupon has passed on this attempt, the control system 60 will be signaled to maintain the new pressure (also known as the new closed position) exerted on the surface of the each coupon from the coupon source. In the event that the coupon has still not passed, more pressure will be signaled, again utilizing the motor 28 to adjustably slide the main carriage housing 26 further in the closed position, to be placed onto the surface of the next coupon. This process continues until the coupon sensor detects that the coupon has passed.

It is also contemplated by the present coupon separation apparatus can be dynamic, and adapt to using multiple types of coupons without having to stop the insertion process and manually reset the settings of the apparatus, including the space of the closed position. For example, in certain instances it may be desired to insert 100 two-dimensional coupons followed by 100 plastic three-dimensional rings and back again. It is contemplated that the 100 coupons and 100 rings may be from the same coupon source, i.e., the last coupon is separately attached to the first ring. Additionally, or alternatively, it is contemplated that a feeding system is used to feed the coupons/rings into the apparatus. In the instance where the two different coupons are from the same coupon source, the first 100 coupons will be distributed as previously described. Upon entry of the first ring, however, the control system will automatically cause the main carriage housing to move to the fully open position. It is also contemplated that differing coupons may be alternated, such that a coupon is followed by a ring and then followed by another coupon. Thus, it is contemplated that individual pressure measurements may be taken and dynamically adjusted between coupons. The pressure measurements can be taken by a combination of a coupon sensor and a torque sensor or monitor. Once the correct torque has been determined, the main carriage housing will shift to either the closed position or the open position to exert the correct amount of pressure on the coupon as has been described herein. It is contemplated that the control system may also be programmed to automatically adjust for the differences in coupons. Due to the difference in height of the two coupons, the main carriage will close until exerting pressure on the top of the first ring. Once the correct closed position has been determined, the process of separation will continue as described herein.

While a particular embodiment of the present coupon insertion apparatus has been described herein, it will be appreciated by those skilled in the art that changes and modifications may be made thereto without departing from the invention in its broader aspects and as set forth in the following claims.

What is claimed is:

1. A method for inserting coupons from a coupon source to a receiving container, the method comprising the steps of:

feeding an entering coupon from the coupon source into at least one pair of opposed rollers and being adjustable between a closed position and an open position; wherein the at least one pair of opposed rollers includes an upper roller mounted to a main carriage housing and a lower roller mounted to a frame;

automatically slidably adjusting the position of a main carriage system including the main carriage housing a motor to move the main carriage housing relative to the lower roller mounted to the frame so as to apply an adjustable pressure to the entering coupon to effectuate separation of the entering coupon from the coupon source by positioning the at least one pair of rollers in the closed position, said adjustment of the main carriage housing being made as a function of sensed torque of the motor; and driving said opposed rollers in both the closed and open positions such that the entering coupon is separated from the coupon source and directed across a second pair of opposed rollers and into a receiving container.

2. A coupon insertion apparatus for inserting coupons from a coupon source into receiving containers, comprising:

a machine frame;

at least one pair of opposed rollers including at least one upper roller and at least one lower roller mounted to said machine frame and being adjustable between a closed position and an open position;

a moving carriage system including a main carriage housing having said at least one upper roller automatically slidably adjustable between said closed and open positions;

when in said closed position said main carriage pressures a surface of an entering coupon for effectuating separation of the entering coupon from the coupon source;

a control system constructed and arranged for automating movement of said main carriage relative to said machine frame;

said moving carriage system includes a motor controlled by said control system and connected to a lead screw shaft for adjusting the position of said main carriage along said lead screw shaft; and said moving carriage system includes an orientation sensor constructed and arranged for determining the orientation of said coupon insertion apparatus and communicating said orientation to said control system.

3. The apparatus of claim 1 wherein said control system adjusts the pressure exerted by the main carriage on the surface of the entering coupon based in part on the orientation of the apparatus relative to a pull of gravity.

4. The apparatus of claim 1 wherein said main carriage is slidably adjustable along a pair of spaced, parallel rails located parallel to the lead shaft screw.

5. The apparatus of claim 4 wherein the pressure exerted is adjusted by said control system to change the torque applied by the motor on said lead screw shaft to move said main carriage to said closed position.

6. The apparatus of claim 5 wherein said control system moves said main carriage to said closed position for at least one to six seconds or until the motor stalls.

7. The apparatus of claim 1 wherein control system also includes a motor torque component for adjusting the amount of torque utilized in moving the main carriage housing to a closed position.

8. The apparatus of claim 1 further including at least a second pair of opposed rollers, wherein a coupon sensor is located between said first and said second pairs of opposed rollers for detecting movement of the coupons from said coupon source between said first and said second pairs of opposed rollers.

9. The apparatus of claim 8 wherein said coupon sensor communicates with said control system and registers each coupon that is successfully passed from said first set of rollers to said second set of rollers.

10. The apparatus of claim 8 wherein said coupon sensor sends a signal to said control system when no coupon is passed from said first set of rollers to said second set of rollers.

11. The apparatus of claim 8 wherein said coupon sensor sends a signal to said control system when a coupon is passed from said first set of rollers and not grasped by said second set of rollers.

12. The apparatus of claim 11 wherein said coupon sensor communicates to said control system that a coupon was not grasped by said second set of rollers and said control system automatically moves the main carriage further in the closed position to cause more pressure to be exerted on the surface of the coupon so as to facilitate grasping of the ticket.

13. The apparatus of claim 12 wherein said coupon sensor is connected to said control system to detect whether said coupon has passed in response to the increased pressure and communicates such information to said control system.

14. The apparatus of claim 13 wherein said control system causes more pressure to be exerted on the surface of the coupon when said coupon sensor communicates that said coupon has not passed from said first set of rollers to said second set of rollers.

15. The apparatus of claim 12 wherein said control system maintains increased pressure on the surface of said entering coupon when said coupon sensor communicates that said coupon has passed from said first set of rollers to said second set of rollers.

16. A coupon insertion system for inserting coupons from a coupon source into receiving containers, the system including:

a portable frame;

at least one pair of opposed rollers mounted to said frame and being adjustable between a closed position and an open position;

a moving carriage system including a main carriage automatically slidably adjustable between said open and closed positions, when in said closed position said main carriage pressures a surface of an entering coupon for effectuating separation of the entering coupon from the coupon source;

a control system for automating movement of the main carriage; and said moving carriage system includes an orientation sensor constructed and arranged for determining the orientation of said main carriage and communicating said orientation to said control system.

17. The coupon insertion system of claim 16 wherein said portable frame is mounted on a stand having wheels; wherein said stand can be added to an existing assembly line.

18. The coupon insertion system of claim 16 wherein said portable frame is mounted above an existing assembly line.

* * * * *